US007434803B2

(12) United States Patent
De Dompierre

(10) Patent No.: US 7,434,803 B2
(45) Date of Patent: Oct. 14, 2008

(54) METHOD AND STATION FOR UNBLANKED SHEET DELIVERY IN A MACHINE PROCESSING PLATE ELEMENTS

(75) Inventor: Jean-Bernard De Dompierre, Echandens (CH)

(73) Assignee: Bobst S.A. (CH)

( * ) Notice: Subject to any disclaimer, the term of this patent is extended or adjusted under 35 U.S.C. 154(b) by 399 days.

(21) Appl. No.: 11/250,271

(22) Filed: Oct. 14, 2005

(65) Prior Publication Data

US 2006/0082046 A1 Apr. 20, 2006

(30) Foreign Application Priority Data

Oct. 15, 2004 (CH) ..... 1699/04

(51) Int. Cl.
*B65H 29/04* (2006.01)
*B65G 29/00* (2006.01)

(52) U.S. Cl. ..... 271/206; 271/204; 271/85; 271/312; 198/867.07; 294/116

(58) Field of Classification Search ..... 271/204–206, 271/82, 85, 900, 311, 312, 307, 207, 220; 198/867.07, 803.9; 294/116
See application file for complete search history.

(56) References Cited

U.S. PATENT DOCUMENTS

| | | | | | |
|---|---|---|---|---|---|
| 2,258,880 | A | | 10/1941 | Bobst | 164/87 |
| 3,730,517 | A | * | 5/1973 | Norton | 271/183 |
| 3,831,932 | A | * | 8/1974 | Conrad | 271/182 |
| 4,085,930 | A | * | 4/1978 | Weisgerber et al. | 271/204 |
| 4,205,606 | A | * | 6/1980 | Jiruse | 101/240 |
| 4,582,316 | A | * | 4/1986 | Wirz | 271/300 |
| 4,643,414 | A | * | 2/1987 | Weisgerber | 271/183 |
| 4,968,081 | A | * | 11/1990 | Beight et al. | 294/104 |
| 5,125,640 | A | | 6/1992 | Yerly et al. | 271/204 |
| 5,172,802 | A | * | 12/1992 | Wells | 198/470.1 |
| 5,244,078 | A | * | 9/1993 | Silva et al. | 198/464.3 |
| 5,351,946 | A | * | 10/1994 | Kamoda et al. | 271/206 |
| 5,409,208 | A | * | 4/1995 | Schmid | 271/204 |

(Continued)

FOREIGN PATENT DOCUMENTS

FR 923047 6/1947

OTHER PUBLICATIONS

European Search Report EP 04 40 5644 dated Feb. 25, 2005.

*Primary Examiner*—Patrick Mackey
*Assistant Examiner*—Luis A Gonzalez
(74) *Attorney, Agent, or Firm*—Ostrolenk, Faber, Gerb & Soffen, LLP

(57) ABSTRACT

A delivery station and a method for unblanked sheet delivery uses a delivery pull-out frame provided with front jogging stops and transverse gripper bars. The ends of the bars are fixedly attached to two respective endless loops flexible drive elements for conveying the sheets in process. The front jogging stops of the delivery pull-out frame are spaced apart to allow the passage between them of grippers of the gripper bar. The gripper bar is inclined around a transverse shaft, for lowering the level of the grippers below the level of the respective upper edges of the front jogging stops, by simultaneously opening the said grippers, in order to separate the sheet from the grippers by bringing the front edge of the sheet against the front stops.

5 Claims, 2 Drawing Sheets

U.S. PATENT DOCUMENTS 5,415,392 A * 5/1995 Maul ..... 271/277
5,911,416 A * 6/1999 Klopfenstein ..... 271/223
5,974,683 A * 11/1999 Shibata ..... 34/88
6,039,317 A * 3/2000 Kramer ..... 271/204
6,089,158 A * 7/2000 Barroso ..... 101/232
6,116,592 A * 9/2000 Gunschera ..... 271/204
6,152,441 A 11/2000 Vossen ..... 271/85
6,237,751 B1 * 5/2001 Ratz ..... 198/803.7
6,311,968 B1 * 11/2001 Linder et al. ..... 270/52.25
6,419,223 B1 * 7/2002 Sting et al. ..... 271/268
6,488,278 B1 * 12/2002 Hansch ..... 271/268
6,612,567 B1 * 9/2003 Kaya ..... 271/206
6,691,996 B2 * 2/2004 Kaya et al. ..... 270/52.25
7,017,640 B2 * 3/2006 Winter et al. ..... 156/562
7,232,123 B2 * 6/2007 Forch et al. ..... 271/82
7,237,479 B2 * 7/2007 Pollien ..... 100/151
2002/0060410 A1 * 5/2002 Uera et al. ..... 271/204
2003/0160383 A1 * 8/2003 Hirai ..... 271/207
2004/0188926 A1 * 9/2004 Tamura ..... 271/207

* cited by examiner

METHOD AND STATION FOR UNBLANKED SHEET DELIVERY IN A MACHINE PROCESSING PLATE ELEMENTS

BACKGROUND OF THE INVENTION

The present invention refers to a method and to a station for unblanked sheet delivery in a machine which processes plate elements, comprising a delivery frame provided with jogging stops and transverse gripper bars. The respective ends of the gripper bars are fixedly attached to two respective flexible drive elements, preferably in the shape of endless loops, for conveying the sheets in process.

When diecutting cardboard sheets or plates in a diecutting press, it is possible, according to the kind of job carried out in the press, to collect the blanks separately in the form of distinct piles or to deliver the unblanked sheet, particularly if it is to be processed in another machine, after the sheet diecutting operation and before the blanking operation.

In the first case, the front edges of the respective sheets remain seized in the grippers of the gripper bar of the sheet conveying device and after the blanking operation, the waste of the sheet is driven by the gripper bar towards the waste removal station.

In the second case, the sheet is released by the gripper bar and a stripper pushes it backwards by coming against its front edge in order to take it out of the grippers and stack it on a single storage pile formed between vertical jogging stops adjusted to the size of the sheets to be stacked.

The use of a conventional stripper is necessary to stop the sheet in order to take it out of the grippers of the gripper bar. However, the stripper has to be moved in the opposite direction to the sheet in order to encounter the sheet by passing between the grippers of the gripper bar at the time when these grippers open. That is the reason for the back motion imparted to the sheet when stopping it. Considering the kinetic energy of the sheet at the time it encounters the stripper, its abrupt stopping with back motion causes deformation of the sheet which propagates like a wave through it. This deformation wave has a risk of breaking the nicks connecting the previously diecut blanks to the sheet or even connecting them together. This is obviously undesirable since these nicks should keep the sheet entire, despite the diecutting of the blanks, until the time chosen for separating the blanks.

SUMMARY OF THE INVENTION

The aim of the present invention is to reduce the deformation of the sheets at the time they are stopped for stacking them in the delivery frame of the delivery station of the processing machine.

To this end, this invention refers to a delivery station and a method for unblanked sheet delivery in a delivery station of a machine processing plate elements. The station comprises a delivery pull-out frame provided with jogging stops and transverse gripper bars. The opposite ends of the bars are fixedly attached to two respective endless loops flexible drive elements for conveying the sheets in process. The front jogging stops of the delivery pull-out frame are spaced apart to allow the passage between them of the grippers of the gripper bar. Each gripper bar is inclined around a transverse shaft, for lowering the level of the grippers of the bar below the level of the respective upper edges of the front stops, by simultaneously opening the grippers, in order to separate the sheet from the grippers by bringing its front edge against the front stops.

In the method of the present invention, the sheet stripper is omitted, so that the sheets are no longer subject to a back motion transmitted by the stripper. This method for unblanked sheet delivery substantially reduces the deformation of the sheet induced by its deceleration at the time of its stopping, because it is no more subject to a back motion or, consequently, to the risk of breaking the nicks connecting the blanks diecut into the sheet.

Advantageously, the first and second cams of the delivery station are mounted to be removable with respect to the path of the gripper bars so that this station can operate according to the blanking method, in which the grippers of the gripper bars must remain closed in order to remove the waste portion of the sheet fixedly attached to the grippers of the gripper bar.

Other features and advantages of the present invention will become apparent from the following description of the invention which refers to the accompanying drawings.

BRIEF DESCRIPTION OF THE DRAWINGS

The accompanying drawings illustrate, schematically and by way of example, an embodiment of a delivery station in a sheet processing machine, adapted to the working of the method, which are objects of this invention.

DESCRIPTION OF A PREFERRED EMBODIMENT

By way of introduction to the following description it is specified that the terms sheet, plate or plate element are interchangably used for paper, cardboard or corrugated cardboard, plastic or laminated sheets. The processing machine is in particular a machine for diecutting blanks into plate elements.

Figure 1:
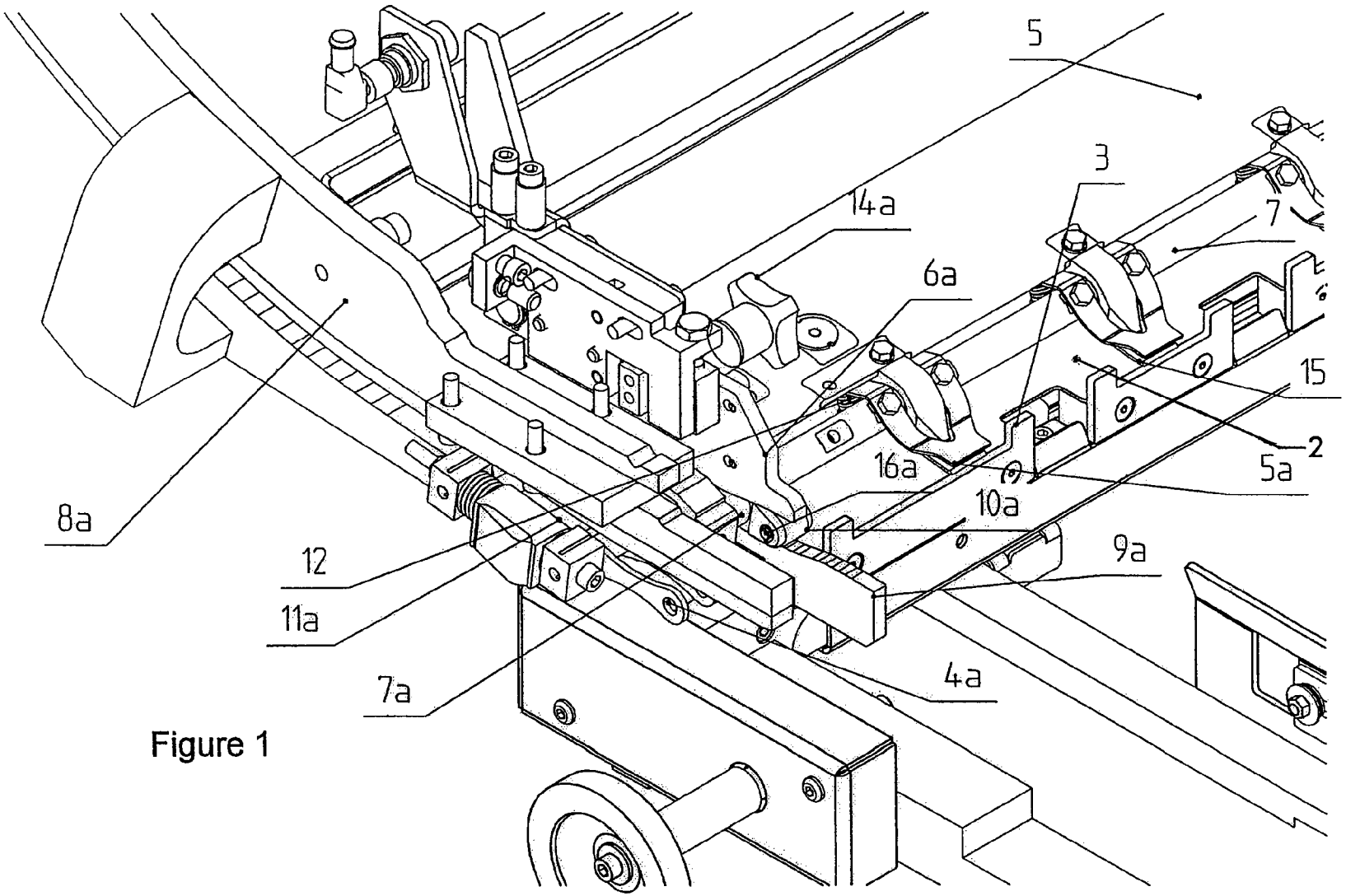
FIG. 1 is a partial perspective view of this station for unblanked sheet delivery.

Due to the fact that both sides of the station for unblanked sheet delivery of the described machine are symmetrical, or at least the elements necessary for the understanding of the invention, only the operator's side of this delivery station is shown in FIG. 1 and is described. The reference numerals of the elements which exist on both sides of the delivery station are added by the letters "a" for the elements on the operator's side, respectively "b" on the opposite operator's side. For this reason, the reference numerals added by the letter "b" are not shown in the drawing but are given in the text in order to mention the elements which are symmetrical to those shown on the operator's side of the delivery station.

The delivery station SR of the machine processing plate elements, partially illustrated on FIG. 1, includes a frame 1 on which is slidably mounted a pull-out frame 2 for unblanked sheet delivery provided with front jogging stops 3 which are spaced from one another for the passage of the grippers of the gripper bar, as will be explained afterwards. This pull-out frame 2 is slidably mounted on the support for receiving the lower blanking tool, when the delivery station is not delivered with unblanked sheets but with separated sheets.

The frame 1 further carries two parallel endless chains 4*a*, 4*b* laterally arranged on both sides of the path of the sheets in the processing machine. These chains 4*a*, 4*b* are conventionally engaged with chain wheels (not shown) and are driven by one of them engaged with the drive motor (not shown) of the machine. These chains 4*a*, 4*b* are fixedly attached to the two respective ends of gripper bars 5 which transversely extend to the path of the sheets in the processing machine and hence parallel to the transverse edges of these sheets. The grippers 5*a* of the gripper bar 5 are directed backwards of the gripper bar with respect to the conveying direction F of these sheets and are used for seizing the front edges of the sheets in order to convey them through the processing machine. The lower arms of these grippers 5*a* are fixed whereas their upper arms are fixedly attached to a transverse support shaft 7.

The connection between the ends of the gripper bar 5 and the chains 4*a*, 4*b* is obtained by two respective connecting pieces 11*a*, 11*b* which are also used as a swivelling bearing for the respective ends of the transverse support shaft 7 which further passes into supporting bearings (not shown) distributed along the gripper bar 5. The upper arms of the grippers 5*a* are elastically pressed in closing position of the grippers 5*a* by pull-back springs 12.

The station SR for unblanked sheet delivery includes, on the respective paths of two rollers 7*a*, 7*b* carried by the ends of the support shaft 7 of the grippers 5*a* of the gripper bar 5 and at the downstream end of this station, two lowering cams 6*a*, 6*b* of the support shaft 7 of the gripper bar 5. The lowering of the support shaft 7 causes a traction on the chains 4*a*, 4*b* so that the rear part of the gripper bar 5 can be lowered by some mm. The chains 4*a*, 4*b* are guided by the chain wheels (not shown) and also by fixed guides 8*a*, 8*b* which are arranged on the internal side of the paths of these chains 4*a*, 4*b*, at the exit of the delivery station SR, where the respective paths of these chains 4*a*, 4*b* become incurved.

The downstream transverse part of the pull-out frame 2 carries at least one, and preferably two lower cams 9*a*, 9*b* for opening the grippers 5*a* of the gripper bar 5. These lower cams 9*a*, 9*b* are respectively arranged near the ends of this downstream transverse part of the pull-out frame 2, on the respective paths of two opening rollers 10*a*, 10*b* of the upper arms of the grippers 5*a*. These opening rollers 10*a*, 10*b* are pivotally mounted on axes 16*a*, 16*b* parallel to the support shaft 7 of the upper arms of the grippers 5*a* of the gripper bar 5, and are attached by a lever 15 to the support shaft 7, so as to turn it around its longitudinal axis by driving the upper arms of the grippers 5*a*, against the pressure of the pull-back springs 12 and to space these upper arms from the lower arms, as particularly illustrated by FIG. 2.

Figure 2:
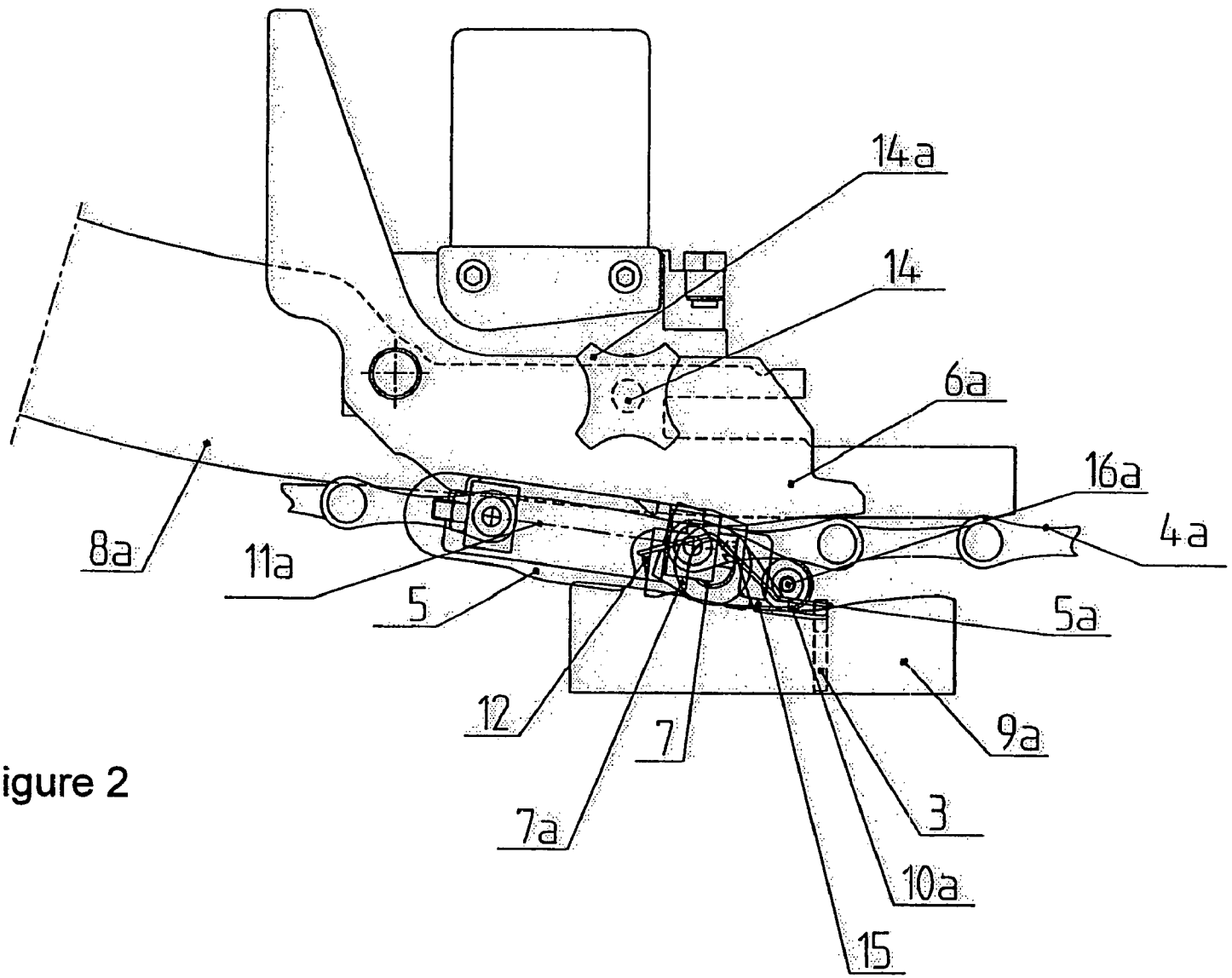
FIG. 2 is an enlarged lateral view of a detail of FIG. 1.

It should be noted that the upper cams 6*a*, 6*b* are located at such a level that the rear ends of the grippers 5*a* pass below the upper edges of the front jogging stops 3 of the pull-out frame 2 for unblanked sheet delivery, as particularly illustrated by FIG. 2. The level of the lower cams 9*a*, 9*b* is also chosen so that the lowering of the rear part of the gripper bar 5 presses the opening rollers 10*a*, 10*b* of the grippers 5*a* against the lower cams 9*a*, 9*b*, causing the opening of the grippers 5*a* at the time of their passage between the front jogging stops 3. Therefore, the sheets kept by the grippers 5*a* are stopped by the jogging stops 2 which are static, contrary to strippers which move in opposite direction to the sheets. Consequently, owing to the method for unblanked sheet delivery according to the invention, the lowering of the rear part of the gripper bar 5 allows opening of the grippers, what is per se made on all gripper bars, but the novelty is due to the fact that this opening is obtained when the grippers 5*a* of the gripper bar 5 are at the same time lowered and pass between the front jogging stops 3 of the pull-out frame 2, allowing these jogging stops 3 to additionally act as static strippers of the unblanked sheets.

This stripping method substantially reduces the deformation wave of the sheet, arising from its stopping, due to the fact that only the sheet is moving whereas the stops 3 are fixed, contrarily to the conventional stripper which moves in opposite direction to the sheet.

When the station is used for the delivery of blanks which are diecut in the sheet in the form of separated blanks, the pull-out frame 2 must be laterally taken out of the machine and replaced by the lower blanking tool. Since the lower cams 9*a*, 9*b* for opening the grippers 5*a* of the gripper bars 5 are fixedly attached to the pull-out frame 2, its removal also causes the removal of these cams 9*a*, 9*b*.

On the other hand, the upper cams 6*a*, 6*b* for lowering the support shaft 7 of the grippers 5*a* of the gripper bar 5 have to be retracted in order to prevent a collision of the gripper bars 5 with the lower blanking tool. To this end, each upper cam 6*a*, 6*b* is attached to the frame 1 by a swivelling axis 13. Two threads (not shown) provided in the frame and located on an arc of a circle centred on the swivelling axis 13 of each upper cam 6*a*, 6*b* are aimed at selectively receiving a threaded rod 14 controlled by a handle 14*a* fixedly attached to its external end. When the respective threaded rods are screwed by means of the handles 14*a* into the respective lower threads of the frame, the upper cams 6*a*, 6*b* are in their respective lowered positions, corresponding to the unblanked sheet delivery. When the same threaded rods 14 are screwed into the upper threads of the frame, the cams 6*a*, 6*b* are in their raised positions and do not come into contact with the gripper bars 5, corresponding to the separated blank delivery.

Even if manually controlled means for activating or desactivating the cams 6*a*, 6*b* for lowering the gripper bar have been described hereinbefore, instead of the manual control, a cylinder or motor control, for example, could be used. Likewise, any other type of manual control than the described one could also be used.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A delivery station for unblanked sheet delivery of machine processing plate elements, comprising a delivery frame having front jogging stops, the jogging stops being positioned to be engaged by the plate elements, the jogging stops having upper edges;

transverse gripper bars, the bars having respective ends; operable and closeable grippers on the gripper bars;

a respective flexible drive element to which an end of the gripper bars is attached for conveying the sheets in process, at least one first cam positioned and operable for lowering the grippers of the gripper bar below respective upper edges of the front jogging stops of the delivery frame; and at least one second cam positioned and operable for opening the grippers when the grippers are in their lowered positions.

2. The delivery station according to claim 1, wherein the first and second cams are removably mounted with respect to the path of the gripper bars to allow operating according to a blanking method.

3. The delivery station according to claim 1, wherein the second cam is fixedly attached to the delivery pull-out frame, and the frame mounted removably in the station.

4. The delivery station according to claim 1, wherein the drive element is in the form of an endless loop.

5. The delivery station according to claim 1, further comprising two of the flexible drive elements each attached to a respective end of the gripper bars.

* * * * *